United States Patent [19]

Moyer

[11] 3,991,555

[45] Nov. 16, 1976

[54] DIGITAL TIMING CIRCUIT FOR DISPLAY SEQUENCING IN TWO-DIGIT WRISTWATCH

[75] Inventor: Norman E. Moyer, Newport Beach, Calif.

[73] Assignee: Hughes Aircraft Company, Culver City, Calif.

[22] Filed: Sept. 13, 1974

[21] Appl. No.: 505,896

[52] U.S. Cl. ..... 58/50 R; 58/153

[51] Int. Cl.[2] ..... G04B 19/30; G04C 21/32

[58] Field of Search ..... 58/23 R, 50 R, 153

[56] References Cited

UNITED STATES PATENTS

| | | | |
|---|---|---|---|
| 3,672,155 | 6/1972 | Bergey et al. | 58/50 R |
| 3,754,392 | 8/1973 | Daniels | 58/127 R |
| 3,854,277 | 12/1974 | Samejima | 58/50 R |

*Primary Examiner*—E. S. Jackmon

*Attorney, Agent, or Firm*—Fay I. Konzem; W. H. Mac Allister

[57] ABSTRACT

A digital timing circuit in a digital watch with a two digit display. When said circuit is activated by a push-button, the two display elements first display the hours information, next are blank for a short duration, then display the minutes information, then go blank until the button is pushed again.

9 Claims, 4 Drawing Figures

| DO | DH | Display |
|---|---|---|
| 0 | X | Blank |
| 1 | 1 | Hours |
| 1 | 0 | Minutes |

X = Don't Care

DIGITAL TIMING CIRCUIT FOR DISPLAY SEQUENCING IN TWO-DIGIT WRISTWATCH

BACKGROUND OF THE INVENTION

1. Field of the Invention

This invention relates to a digital timing circuit, and more particularly to a timing circuit in a digital wristwatch for displaying both the hours and minutes information sequentially by using a two digit display.

2. Description of the Prior Art

In the art, digital watches have used four display elements to display the horological information. Usually, two of the display elements display the hours and the other two display elements display the minutes, either liquid crystal or light emitting diode (LED) display elements have been used.

In order to construct a ladies' digital watch the size of the watch and its electronics must be reduced considerably, as compared to the men's digital watch for aesthetic reasons. One of the major limiting factors in the size of the digital watch is that four display elements have been necessary to display the horological information. In the present invention, though, the width of the digital watch can be reduced by almost half the size of the prior art digital watches because only two display elements instead of the four display elements of the prior art digital watches are used.

The digital timing circuit of the present invention allows a digital watch to be constructed, using only two display elements instead of the prior art four display elements, by displaying the time in a sequential manner, first the hours and then the minutes when said circuit is activated by a pushbutton.

SUMMARY OF THE INVENTION

The digital timing circuit, in accordance with the invention, consists of four toggle flip-flops, a latch circuit, four gates, and a pushbutton for activating the timing sequence. With the pushbutton and thereby the timing circuit unactivated, the two display elements in the digital watch are blank. But upon activating said button by depressing it, the timing sequence is begun, in which the display shows a first set of horological information, then the display is blank for a short duration and finally a second set of horological information is displayed and the display goes blank until activated again.

Accordingly, it is an object of this invention to provide a digital timing circuit, in a digital watch, which allows both the hours and the minutes to be displayed in a sequential manner on a two digit display.

Another object is to provide a digital timing circuit which allows the width of a digital watch to be reduced by approximately one-half.

It is a further object to provide a digital timing circuit which will provide a lower power consumption rate from the batteries of said digital watch. This lower power results because fewer digits are on for a shorter time, compared to prior art LED watches.

The features of the present invention which are believed to be novel are set forth with particularity in the appended claims. The present invention, both as to its organization and manner of operation, together with further objects and advantages thereof, may be better understood by reference to the following description, taken in connection with the accompaying drawings.

DETAILED DESCRIPTION

Figure 1:
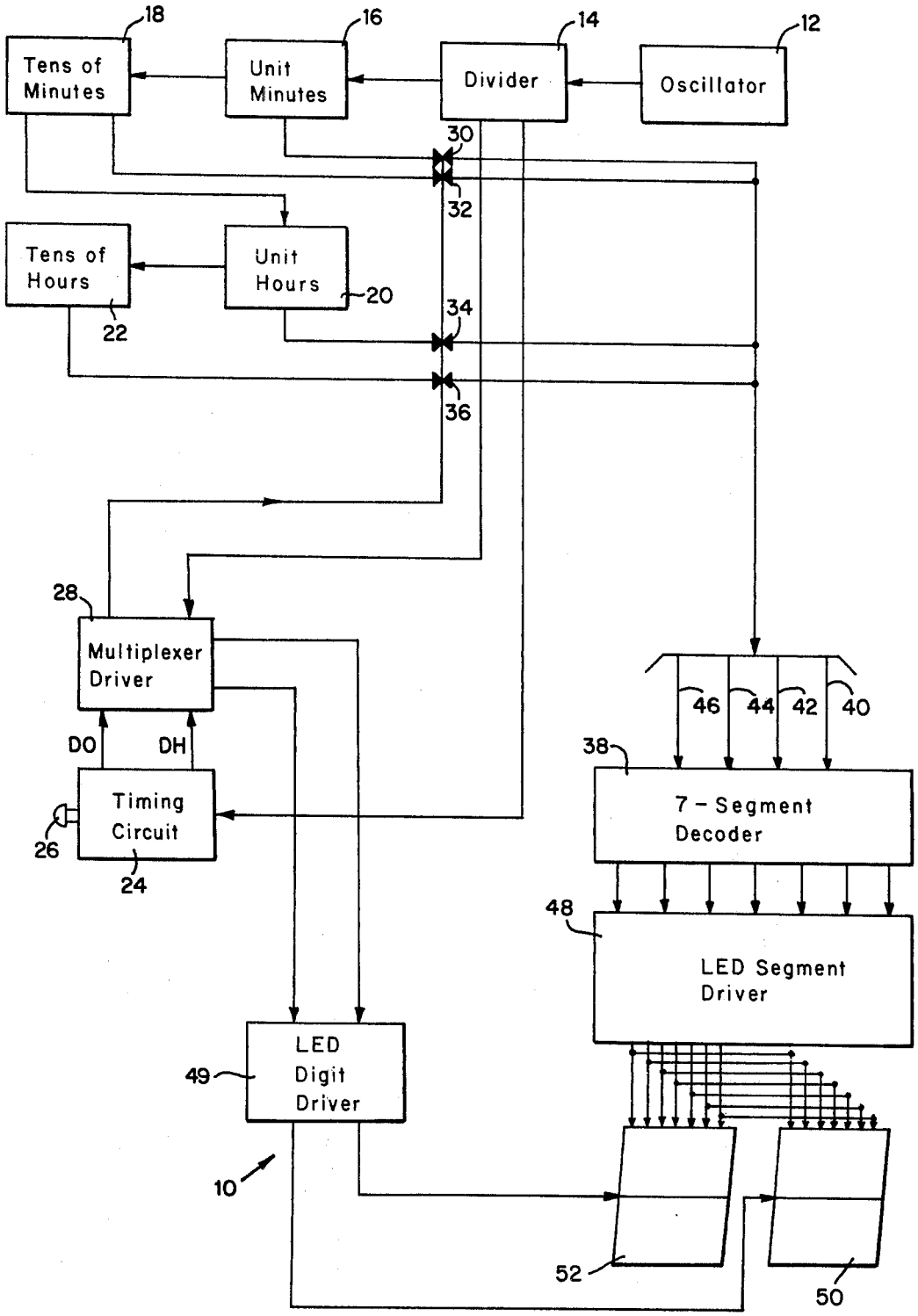
FIG. 1 is a block diagram of the circuitry of a digital watch incorporating the timing circuit of this invention.

Referring to FIG. 1, a block diagram of the electronic digital watch 10 includes an electronic oscillator 12, which is crystal-controlled to oscillate at a predetermined and substantially constant frequency. The output from the crystal-controlled oscillator 12 is driven into a standard CMOS divider 14 which results in an output pulse of one cycle per minute. This is then driven into the unit minutes counter 16, which is a standard CMOS decade counter, which counts from 0 to 9. This unit minutes counter in turn drives the CMOS tens-of-minutes counter 18 which must count from 0 to 5 to satisfy the requirement of 60 minutes per hour. Similar to the unit minutes counter's operation, the tens-of-minutes counter 18 drives the unit hours counter 20, which is a decade counter. The unit hours counter 20, then drives the tens-of-hours counter 22, which counts from 0 to 1. Additional logic circuitry causes the hours counters to go from 12 to 1.

Seven-segment decoder 38 is a device which receives binary coded decimal (BCD) signals from the counters and emits seven signals which correspond to the seven segments of the LED display devices so that, when turned on to be visibly distinctive, the segments represent the digit corresponding to the counter state. Since it is desired to display different horological information, it is necessary to switch different counters into the input of the seven-segment decoder. For simplicity, a single seven-segment decoder 38 is employed, and its inputs are multiplexed. There are four input lines 40, 42, 44, and 46 to the seven-segment decoder, each carrying one bit of the BCD information from the counters. Transmission gate sets 30, 32, 34, and 36 respectively connect BCD counters, 16, 18, 20, and 22 to lines 40, 42, 44, and 46.

Normally, the display elements 50 and 52 are blank, until the digital timing circuit 24 of the present invention is activated by the depression of pushbutton 26. Said timing circuit receives an input signal of 4 Hertz from the divider 14. Timing circuit 24 has two outputs, DO (Display On) and DH ( Display Hours). When the binary level of DH is at a high level, the multiplex driver 28 alternately opens transmission gates 34 and 36 and thus delivers the unit hours and tens-of-hours information to the seven-segment decoder 38. Decoder 38 in turn receives the BCD signals from said counters and emits seven signals which correspond to the seven segments of the LED display devices. The seven signals are then delivered to the LED segment driver 48 which finally displays said signals on LED display elements 50 or 52. Multiplexer driver 28 also delivers signals to the LED digit driver 49 which causes the unit hours information to be displayed on display element 50 and the tens-of-hours information to be displayed on element 52.

When the DO output from timing circuit 24 is at a low binary level the LED display elements are blank.

Finally, when the DH output is at a low binary level, the multiplexer driver 28 alternately opens transmission gate sets 30 and 32 and allows the information from unit minutes counter 16 and tens-of-minutes counter 18 to be delivered to seven-segment decoder 38 which in turn delivers said information in the form of seven signals which correspond to the seven segments of the LED display to the LED segment driver 48. Multiplexer driver 28 also delivers signals to the LED digit driver 49 which causes the unit minutes information to be displayed on LED element 50 and the tens-of-minutes information to be displayed on LED display element 52.

Thus, when pushbutton 26 is depressed, the timing circuit 24 delivers first the hour information to be displayed on the two LEDs 50 and 52 for one-half second, the display is then blanked for one-half second, and then the minutes information is delivered to LED segment driver 48, which in turn displays the information on the LEDs for one-half second, and finally the display goes blank again.

The electronics of such a digital watch as shown in FIG. 1 is disclosed in detail in application Ser. No. 410,744, filed Sept. 29, 1973, entitled "Digital Watch with Liquid Crystal and Light Emitting Diode Displays," by E.C. Ho. The subject matter of this cross-reference is hereby incorporated herein in its entirety.

Figure 2:
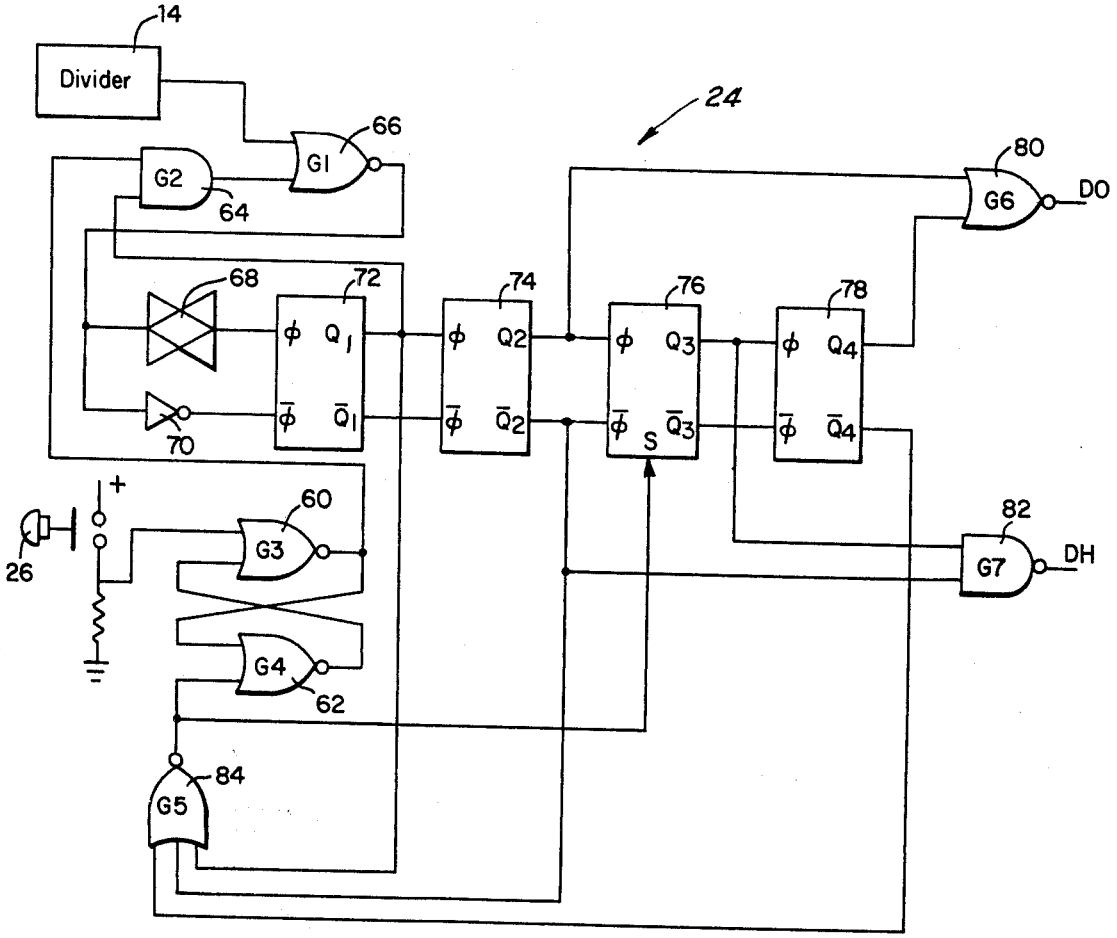
FIG. 2 is a logic diagram of the digital timing circuit of the present invention.

Referring now to FIG. 2, the digital timing circuit 24 consists of pushbutton 26 which is connected to a first input to NOR gate 60. The second input to NOR gate 60 is connected to the output of NOR gate 62. The output of said gate 60 is connected to a first input to NOR gate 62 and to a first input to AND gate 64. The output from said AND gate is connected to a first input to NOR gate 66. The second input to NOR gate 66 is connected to a narrow negative 4-Hertz pulse from divider 14 of FIG. 1. More time is allowed to release the push button 26 if the 4-Hertz has a high duty cycle and switch bounce effects are elminated. The output of NOR gate 66 is, in turn, connected to transmission gate 68 and to inverter gate 70, which form a two phase clock generator. The output of transmission gate 68 is connected to the clock input $\phi$ of toggle flip-flop 72. The output of inverter 70 is connected to the inverse clock input $\overline{\phi}$ of toggle flip-flop 72. The Q1 output of flip-flop 72 is connected to a second input to AND gate 64 and to the $\phi$ input of toggle flip-flop 74. The $\overline{Q}1$ output of flip-flop 72 is connected to the $\overline{\phi}$ input to toggle flip-flop 74. Further, the Q2 output of flip-flop 74 is connected to the $\phi$ input to toggle flip-flop 76 and to a first input of NOR gate 80. The $\overline{Q}2$ output of flip-flop 74 is connected to the $\overline{\phi}$ input of toggle flip-flop 76 and an input of NAND gate 82. The Q3 output of flip-flop 76 is connected to the $\phi$ input of toggle flip-flop 78 and to a first input to NAND gate 82. The $\overline{Q}3$ output of toggle flip-flop 76 is connected to the $\overline{\phi}$ input of toggle flip-flop 78. The Q4 output of toggle flip-flop 78 is connected to a second input of NOR gate 80.

NOR gate 84 has three inputs, a first connected to the Q1 output of toggle flip-flop 72, a second input connected to the $\overline{Q}2$ output of toggle flip-flop 74 and a third input connected to the $\overline{Q}4$ output to toggle flip-flop 78. The output of NOR gate 84 is connected to a second input to NOR gate 62 and to the set input to toggle flip-flop 76.

THE OPERATION

Figures 3, 4:
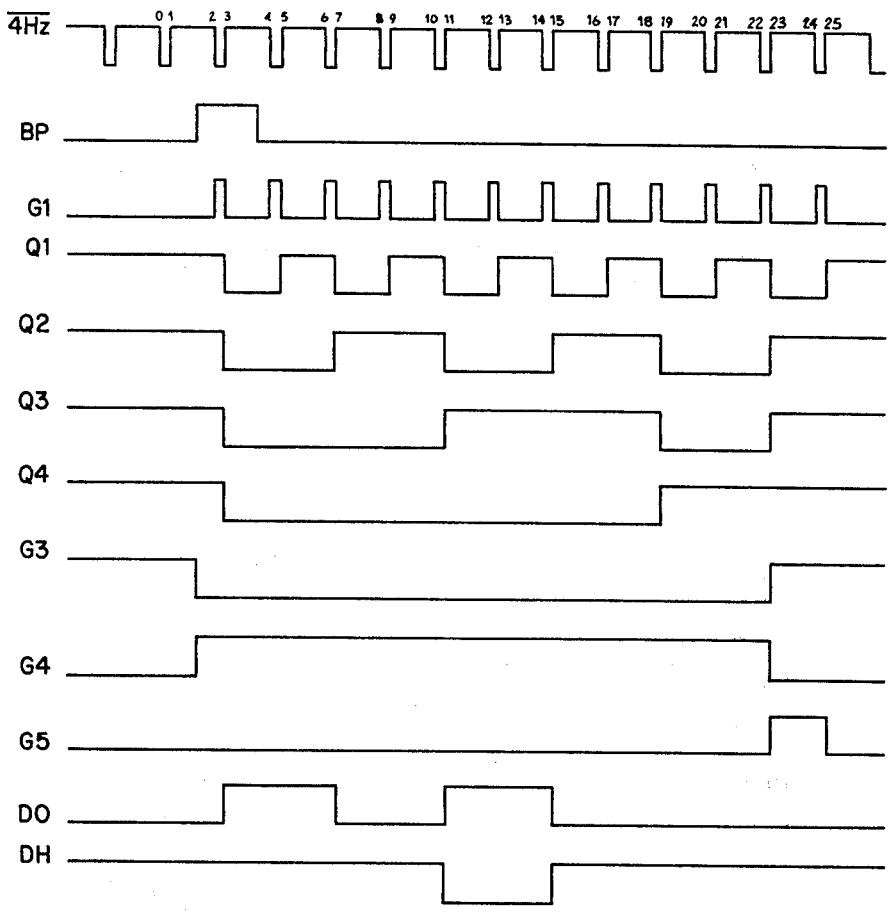
FIG. 3 is a timing diagram for the digital timing circuit of FIG. 2.
FIG. 4 is a truth table showing the necessary conditions to display hours and minutes.

FIG. 3 is a timing diagram for the digital timing circuit of FIG. 2. It is employed to show the operation of said circuit. The normal condition of timing circuit 24, with pushbutton 26 unactivated is shown in FIG. 3, at time *t*0; the outputs of the four flip-flops Q1–Q4 and gate 60 are at a logic high binary level. Thus the negative 4-Hertz pulse is blocked by NOR gate 66 since the output of AND gate 64 is held at a binary high level, therefore nothing happens in the timing circuit until pushbutton 26 is depressed.

When pushbutton 26 is depressed, momentarily, at time *t*1, causing the pushbutton input to NOR gate 60 to go to a binary high level, the output of NOR gate 60 changes states to a logic low level, which in turn causes the output of NOR gate 62 to go high. Since an input to AND gate 64 is now a low logic level, the output from said gate is at a low level. Since the output from AND gate 64 is an input to NOR gate 66, when the negative 4-Hertz pulse, which is the second input to NOR gate 66, goes low at time *t*2, the output from NOR gate 66 will go high.

The output of NOR gate 66 will stay high until its input from the negative 4-Hertz pulse goes high again at time *t*3. When the output from NOR gate 66 goes low at time *t*3, the output Q1 of flip-flop 72 will also go low, as well as the outputs Q2, Q3, and Q4 from flip-flops 74, 76, and 78, respectively. At time *t*3, the Q2 output of flip-flop 74, which is an input to NOR gate 80, is at a low logic level and said NOR gate's other input, the Q4 output of flip-flop 78, is also at a low logic level; therefore, the output from NOR gate 80, DO is at a high level, as shown in FIG. 3. Also, the DH output from NAND gate 82 is at a high level at time *t*3, for its first input from the Q3 output of flip-flop 76 is at a low level. Since the DO and DH outputs are high from time *t*3 to time *t*7, the hours are displayed for one-half second on the two LED display elements.

At time *t*4, on the next falling edge of the 4-Hertz pulse, the output from NOR gate 66 will again go to a high logic level. At time *t*5, which is on the rising edge of the 4-Hertz pulse, the output from NOR gate 66 will go low, causing the output Q1 from flip-flop 72 to go high. At time *t*6, the output of NOR gate 66 again will go high. At time *t*7, the output of NOR gate 66 again will go low, causing the output Q1 from flip-flop 72 also to go low and causing the output Q2 from flip-flop 74 to go high. Finally, at time *t*7, the output of NOR gate 80, DO will go low, since the Q2 input to NOR gate 80 is at a high level.

The truth table of FIG. 4 shows the prerequisite conditions for displaying hours and minutes. When both the DO and the DH outputs are at a high binary level, the hours are displayed, as can be seen in FIG. 3 between the time *t*3 and the time *t*7. Then, between time *t*7 and time *t*11, the DO output is low, thereby causing the display to be blank. Finally, between time *t*11 and time *t*15 the DO output is high and the DH output is low, causing the minutes information to be displayed.

At time *t*9 when the output of NOR gate 66 goes low, the Q1 output of flip-flop 72 goes high until the next falling edge from NOR gate 66, which occurs at time *t*11. At time *t*11, the Q2 output from flip-flop 74 goes low and the Q3 output from flip-flop 76 goes high. Also at time *t*11, the Q2 input to NOR gate 80 is low and the Q4 input to NOR gate 80 is also low; therefore, the output of NOR gate 80 goes to a high logic level. Since the Q3 input to NAND gate 82 is high and the $\overline{Q}2$ input to NAND gate 82 is at a high logic level, the DH output from NAND gate 82 will be at a low logic level. As can be seen from the truth table of FIG. 4, the minutes information will be displayed when the DO output is high and the DH output is low; this condition exists between time *t*11 and time *t*15, as shown in the timing diagram of FIG. 3.

At time *t*15, the Q2 input to gate 80 is at a high logic level and the DO output goes low. As can be seen from truth table of FIG. 4, when the DO output is low the display will be blank.

Finally, when the Q1, $\overline{Q}2$ and $\overline{Q}4$ inputs to NOR gate 84 are at a low level, t23, the output of said gate will go high, thereby causing toggle flip-flop 76 to set and gates 60 and 62 to change output levels. After a 4-Hertz pulse makes Q1 go high, the output from gate 84 goes low and the original condition of waiting for a signal from the activation of the pushbutton 26 exists. This condition is shown at time *t*25.

Although the device which has just been described appears to afford the greatest advantages for implementing the invention, it will be understood that various modifications can be made thereto without going beyond the scope of the invention, it being possible to replace certain elements by other elements capable of fulfilling the same technical functions therein.

What is claimed is:

1. A digital timing circuit for regulating the timing sequence in which two different sets of horological information are displayed on two electro-optical display elements, comprising:

clock means;

counting means connected to said clock means for producng a predetermined timing sequence;

a pushbutton;

latch means for starting said timing sequence and completing it without interruption when activated by said pushbutton; and resetting means connected between said counting means and said latch means for resetting said counting and latch means to the beginning of the timing sequence.

2. The digital timing circuit as recited in claim 1, wherein said counting means is a plurality of flip-flops connected in series.

3. The digital timing circuit as recited in claim 1, wherein said latch means is two cross-coupled NOR gates.

4. The digital timing circuit as recited in claim 1, wherein said resetting means is a NOR gate which resets the counting means and the latch to a predetermined value just prior to the timing sequence being completed.

5. A digital timing circuit in a digital watch with two electro-optical display elements, when said circuit is activated by a pushbutton the timing sequence begins and said display elements display a first set of horological information, then said display elements are blank for a short duration, and finally display a second set of horological information and are then blank again, comprising:

a clock pulse source;

first gate means having first and second input connections and an output connection;

said first input of said first gate connected to said clock pulse source;

second gate means having first and second input connections and an output connection;

said second input of said first gate connected to said output of said second gate;

third gate means having first and second input connections and an output connection;

fourth gate means having first and second input connections and an output connection;

said output of said third gate connected to said first input of said second gate and to said first input of said fourth gate;

said output of said fourth gate connected to said input of said third gate;

a pushbutton for activating said digital timing circuitry, said pushbutton connected to said first input to said third gate;

fifth gate means having first, second, and third input connections and an output connection;

first flip-flop having first and second input connections and first and second output connections;

second flip-flop having first and second input connections and first and second output connections;

third flip-flop having first, second, and third connections and first and second output connections;

fourth flip-flop having first and second input connections and first and second output connections;

two phase clock generating means having an input connection connected to said output of said first gate means and having a first output connected to said first input of said first flip-flop and a second output connected to said second input of said flip-flop;

said first output of said first flip-flop connected to said first input of said second flip-flop, to said second input to said second gate and to said first input to said fifth gate;

said second output of said first flip-flop connected to said second input of said second flip-flop; sixth gate means having first and second input connections and an output connection;

seventh gate means having first and second input connections and an output connection;

said first output of said second flip-flop connected to said first input of said third flip-flop and to said first input of said sixth gate;

said second output of said second flip-flop connected to said second input of said third flio-flop, to said second input of said fifth gate and to said second input of said seventh gate;

said third input to said third flip-flop connected to said output of said fifth gate and to said second input of said fourth gate for forcing said flip-flop into a known state;

said first output of said third flip-flop connected to said first input of said fourth flip-flop and to said first input of said seventh gate;

said second output of said third flip-flop connected to said second input of said fourth flip-flop;

said first output of said fourth flip-flop connected to said second input of said sixth gate;

said second output of said fourth flip-flop connected to said third input of said fifth gate;

first and second electro-optical display elements which display the digits of first and second sets of horological information;

said second set of horological information is displayed on said electro-optical display when said output of said sixth gate is at a logical binary high level and said output of said seventh gate is at a logical binary low level; and said first set of horological information is displayed on said electro-optical display when said outputs of said sixth and seventh gates are at a logical binary high level.

6. The digital timing circuit as recited in claim 5, wherein said second gate is an AND gate and said seventh gate is a NAND gate.

7. The digital timing circuit as recited in claim 5, wherein said first, third, fourth, fifth, and sixth gates are NOR gates.

8. The digital timing circuit as recited in claim 5, wherein said first, second and fourth flip-flops each comprises 16 MOSFETS.

9. The digital timing circuit as recited in claim 5, wherein said third flip-flop comprises 18 MOSFETS.

* * * * *